US006644766B1

(12) United States Patent
Ellson

(10) Patent No.: US 6,644,766 B1
(45) Date of Patent: Nov. 11, 2003

(54) PRINTING SYSTEM WITH PHASE SHIFT PRINTING TO REDUCE PEAK POWER CONSUMPTION

(75) Inventor: Richard N. Ellson, Palo Alto, CA (US)

(73) Assignee: Xerox Corporation, Stamford, CT (US)

( * ) Notice: Subject to any disclaimer, the term of this patent is extended or adjusted under 35 U.S.C. 154(b) by 777 days.

(21) Appl. No.: 09/067,965

(22) Filed: Apr. 28, 1998

(51) Int. Cl.[7] ..... B41J 29/38
(52) U.S. Cl. ..... 347/9
(58) Field of Search ..... 347/9, 15, 57, 347/10, 11, 12, 46, 43, 35, 36, 20, 100, 90

(56) References Cited

U.S. PATENT DOCUMENTS

| | | | | |
|---|---|---|---|---|
| 4,251,824 A | * | 2/1981 | Hara et al. | 347/57 |
| 4,399,443 A | * | 8/1983 | Yasufuku et al. | 347/100 |
| 5,371,530 A | * | 12/1994 | Hawkins et al. | 347/9 |
| 5,589,864 A | * | 12/1996 | Hadimioglu | 347/46 |
| 5,617,123 A | | 4/1997 | Takaoka et al. | 347/15 |
| 5,724,077 A | | 3/1998 | Murata | 347/12 |

FOREIGN PATENT DOCUMENTS

| | | |
|---|---|---|
| EP | 0 422 870 A2 | 4/1991 |
| EP | 0 953 451 A3 | 11/1999 |
| JP | 57 087376 A | 5/1982 |
| JP | 09 136439 A | 5/1997 |

* cited by examiner

*Primary Examiner*—Stephen D. Meier
*Assistant Examiner*—Charles W. Stewart, Jr.

(57) ABSTRACT

In a printing system with multiple printheads, a spot of ink is created on a recording medium using up to N drops of ink fired from an ejector of one of the printheads. Each printhead has an array of ejectors. A single power supply drives the ejectors of the multiple printheads. Each of the printheads delivers a single color such as cyan, magenta, yellow, or black. A memory, which is coupled to the multiple printheads, records a printfile. Values in the printfile record channel values. Each channel value specifies how many drops of ink to deliver onto the recording medium over a spot cycle. The spot cycles of the multiple printheads, which consist of one to N actuation intervals, are desynchronized by operating the spot cycles out of phase with each other. The spot cycles of two printheads, for example, are desynchronized by beginning the spot cycle of one printhead a non-multiple of N drops prior to beginning the spot cycle of the other printhead. Desynchronizing the spot cycles of the printheads reduces the peak power requirements of the printheads by lowering the peak average consumption during any actuation interval of a spot cycle of the acoustic printing system.

19 Claims, 17 Drawing Sheets

FIG. 2
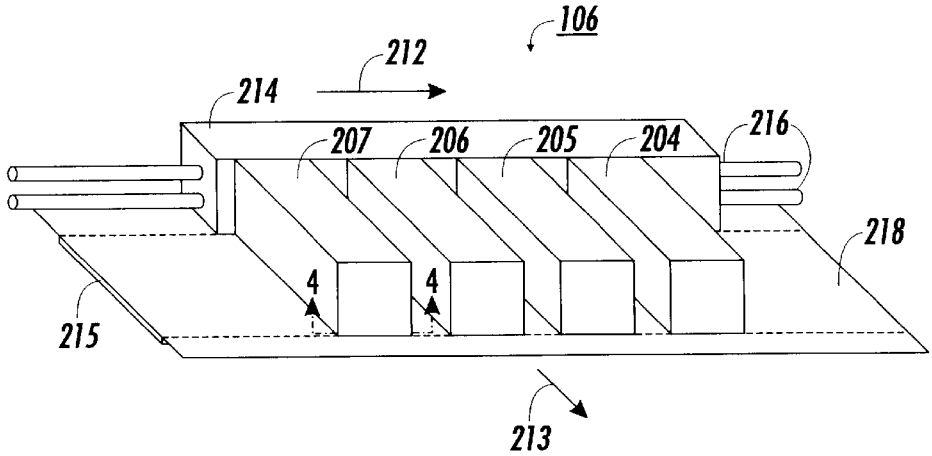
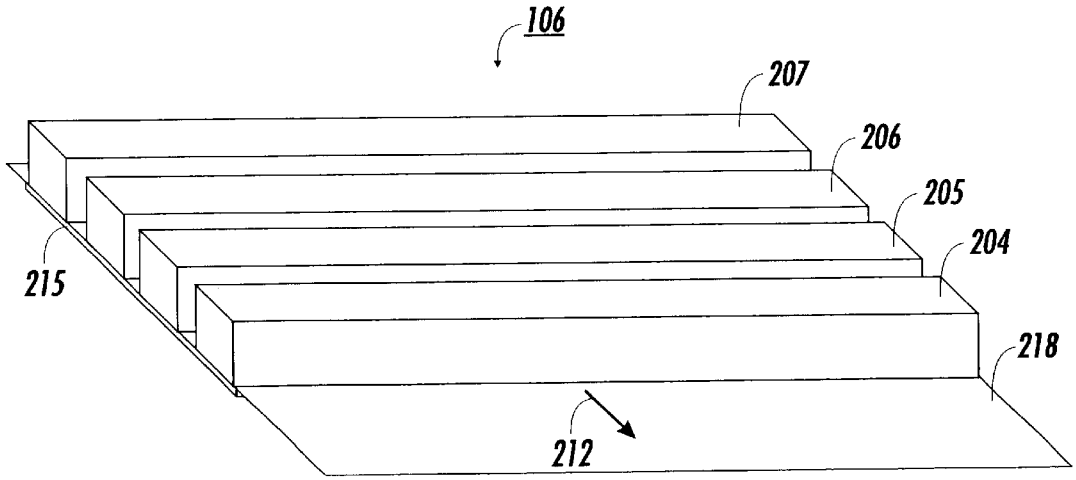
FIG. 3

FIG. 8
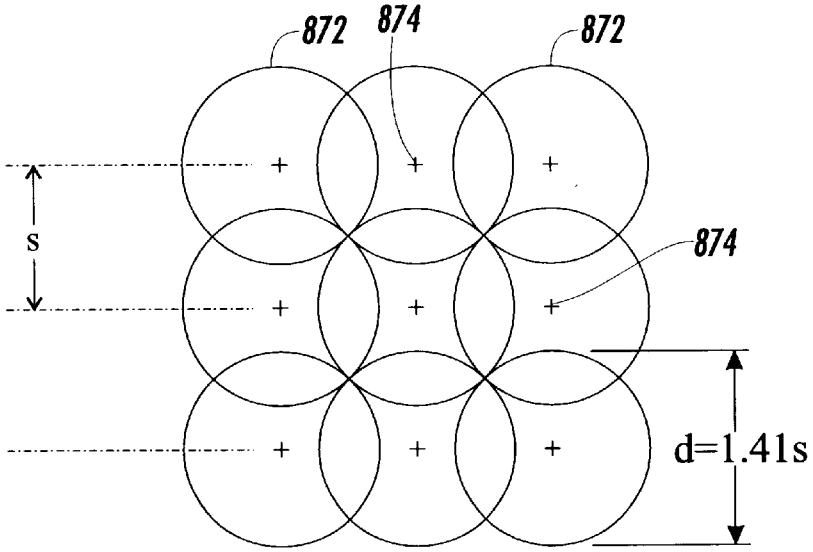
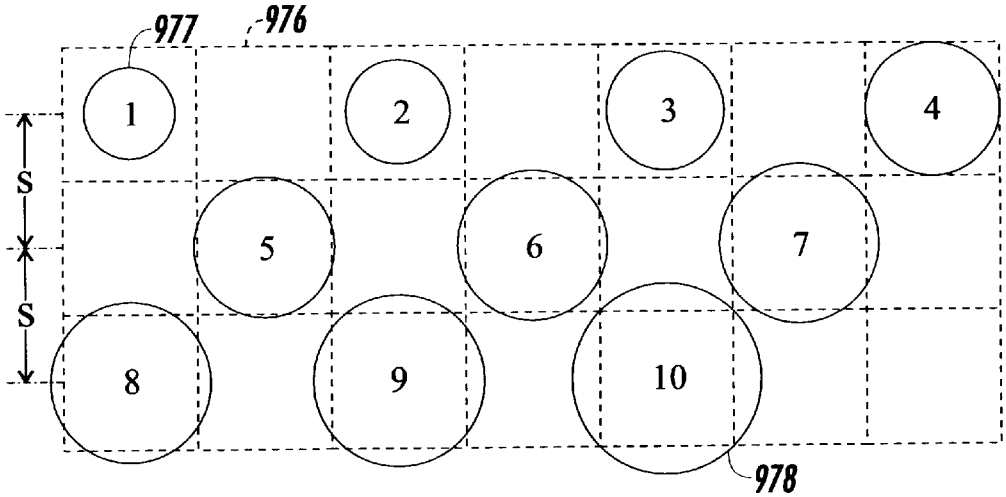
FIG. 9

FIG. 10
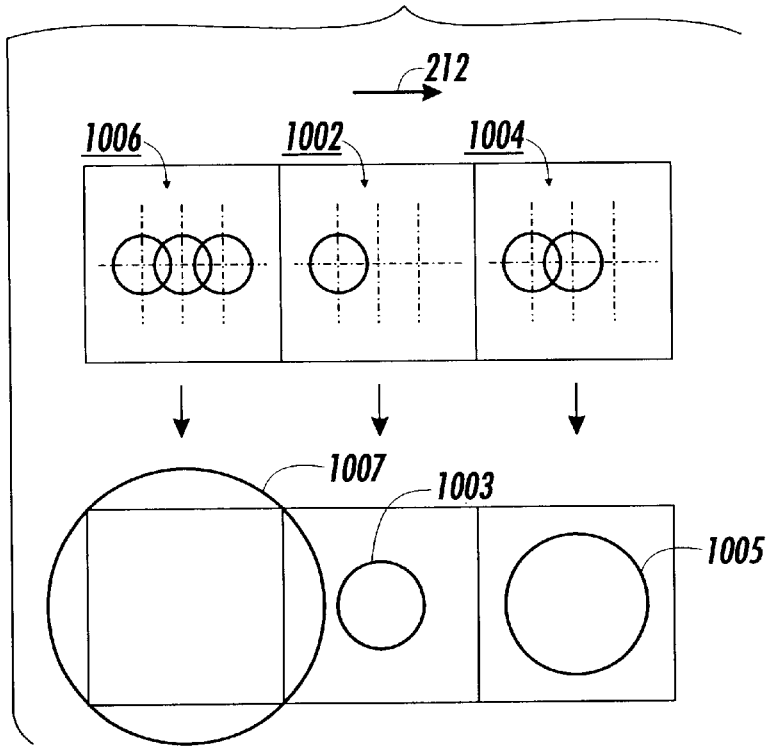
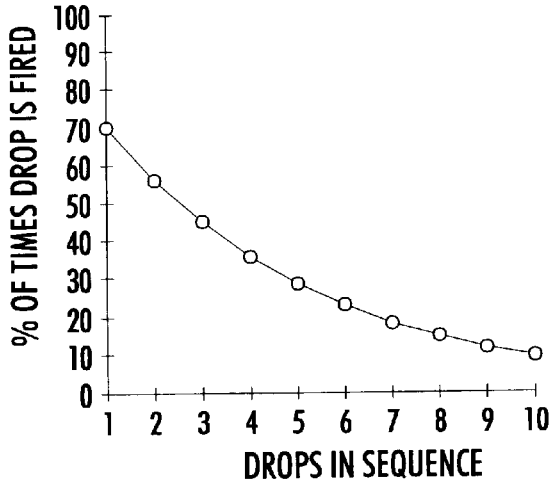
FIG. 11

PRINTING SYSTEM WITH PHASE SHIFT PRINTING TO REDUCE PEAK POWER CONSUMPTION

BACKGROUND OF THE INVENTION

1. Field of the Invention

The present invention relates generally to a multiple drop per spot printing system with multiple printheads, and more particularly, to a method for reducing simultaneous drop ejections from the multiple printheads to reduce peak power consumption of the printing system.

2. Description of Related Art

Ejectors of multiple drop per spot printing systems are known to be able form a spot of ink on a recording medium with multiple drops of ink over a spot (or burst) cycle. More specifically in multiple drop per spot printing systems, each spot of ink is formed on a recording medium over a spot cycle using one or more drops of ink, up to a maximum number of N drops of ink. Examples of multiple drop per spot printing systems include thermal ink jet (TIJ), piezoelectric, and acoustic ink printing (AIP) systems.

Some multiple drop per spot printing systems are configured with two or more printheads. For example, color printing systems have four printheads for individually ejecting one of the colors cyan, magenta, yellow, and black. The printheads of these multiple drop per spot printing systems can be either partial array or full width array printheads. Full width array printheads span an entire page, whereas partial width array printheads span a fraction of a page. Full width array printheads move in a fast scan process direction, whereas partial width array printheads move in a slow scan and a fast scan process direction to achieve full page coverage.

In addition, some multiple drop per spot printing systems that are configured with multiple printheads have a single power supply. The single power supply is used to simultaneously actuate the multiple printheads to fire droplets of ink. Ideally, the single power supply has sufficient power to simultaneously drive all of the ejectors of all of the printheads at one time, thereby achieving 100% coverage on a recording medium. Generally, the peak power demands of a power supply driving multiple printheads during any spot cycle, however, is some level of power that produces less than 100% coverage. In order not to have a power supply with excess capacity, most printing systems assume that the spot cycles of multiple printheads will not require more than some predetermined peak power rate.

Generally, the power supplies for driving multiple printheads is an expensive component of multi spot per drop printing systems, and in particular for acoustic ink printing systems. To minimize the per unit costs of such printing systems, it would be desirable to provide a multiple drop per spot printing system in which the predetermined peak power consumption required for operation is minimized. By minimizing peak power consumption, the power required during any one actuation interval of the printing system's multiple printheads is advantageously reduced.

SUMMARY OF THE INVENTION

In accordance with the invention there is provided a multiple drop per spot printing system and method of operation therefor. The multiple drop per spot printing system includes at least a first printhead and a second printhead that move in a process direction. The two printheads have ejectors for ejecting onto a recording medium drops of ink. Each printhead ejects up to N drops of ink onto the recording medium to form a spot of ink during a spot cycle. A memory is coupled to the first printhead and the second printhead for specifying which ones of the ejectors to actuate during the spot cycles of each printhead. Also, a power supply is coupled to the first printhead and second printhead for simultaneously actuating the ones of the ejectors specified by the memory during the spot cycles of each printhead. The first printhead is offset in the process direction from the second printhead a non-multiple number of N drop separations to desynchronize the spot cycle of the first printhead and the spot cycle of the second printhead. Desynchronizing the spot cycles of the first printhead and the second printhead reduces the number of ejectors of the two printheads that are specified by the memory to be simultaneously actuated by the power supply.

BRIEF DESCRIPTION OF THE DRAWINGS

These and other aspects of the invention will become apparent from the following description read in conjunction with the accompanying drawings wherein the same reference numerals have been applied to like parts and in which:

FIG. 2 illustrates four partial-width acoustic ink printheads for performing the present invention;

FIG. 3 illustrates four page-width acoustic ink printheads for performing the present invention;

FIG. 8 illustrates the locations of ink drops deposited by a single drop per spot printhead in a 1 by 1 pattern;

FIG. 9 illustrates a manner of forming a spot on a recording medium with the multi-drop per spot printhead;

FIG. 10 illustrates how droplets having one to three drops per spot (i.e., N=3) are formed along a fast scan direction on a low addressability grid;

FIG. 11 illustrates a distribution of drops fired over a spot cycle of a multi-drop per spot printer having ten drops per spot;

DETAILED DESCRIPTION

A. Multi-Drop Printing System

Figure 4:
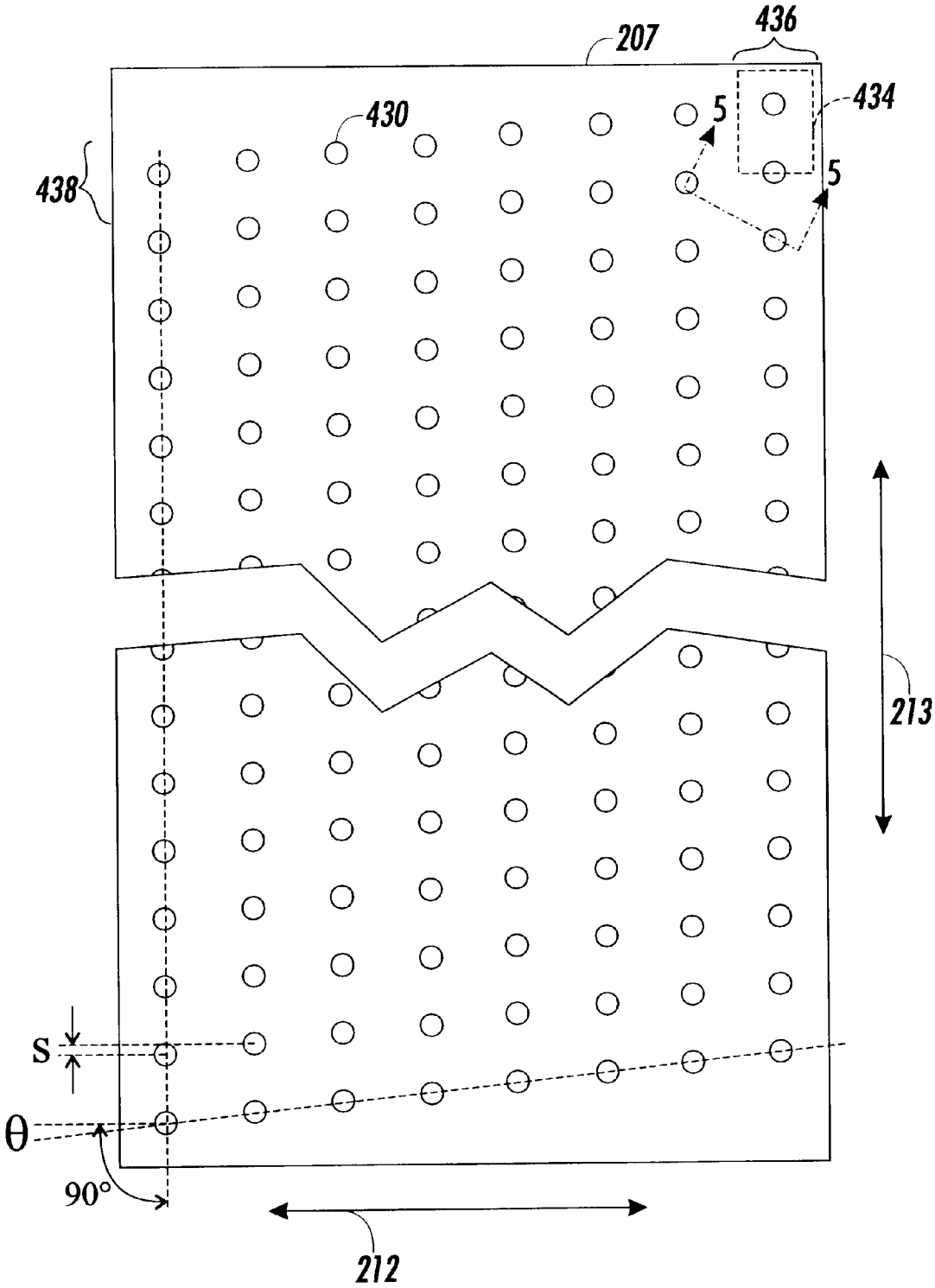
FIG. 4 illustrates a bottom-up schematic depiction of an array of apertures or orifices of the printhead taken along view lines 4—4 in FIG. 2.
Figure 5:
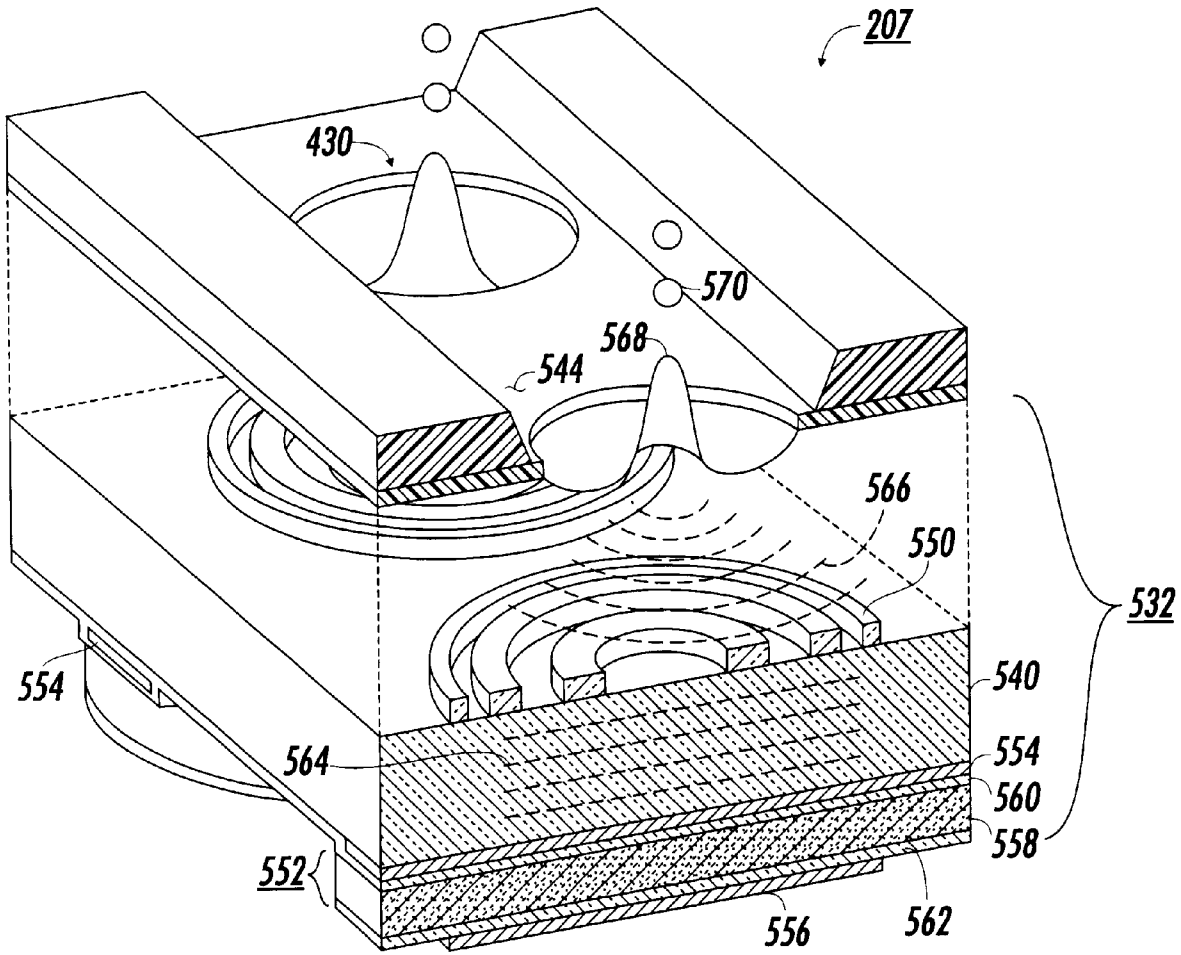
FIG. 5 illustrates a perspective view of a portion of an acoustic ink printhead for carrying out the present invention taken along view lines 5—5 in FIG. 4.

The Figures illustrate a multi-drop per spot printer 106 and a method for carrying out the present invention. In the illustrated embodiments, the multi-drop per spot printer 106, which applies multiple drops of ink to form a spot, utilizes multiple acoustic ink printheads 204–207, one of which is shown in FIGS. 4–5 in detail. Acoustic ink printing is well known in the art and described for example in U.S. Pat. Nos. 4,751,530, 5,041,849, 5,028,937, 5,589,864, and 5,565,113, which are hereby incorporated by reference.

Figure 1:
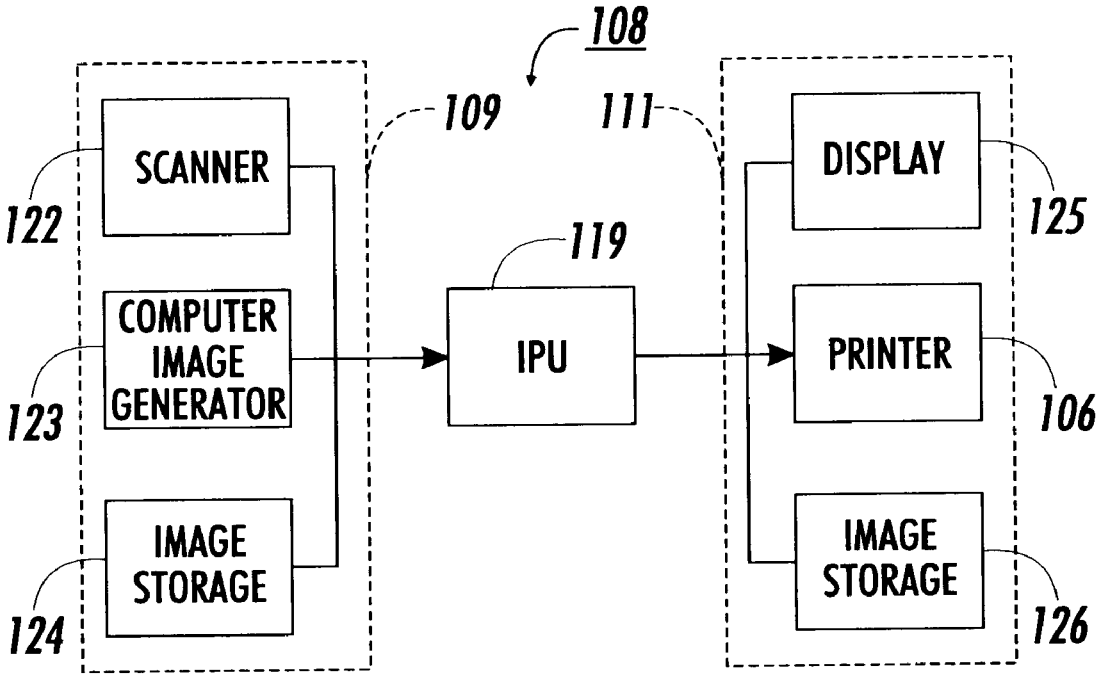
FIG. 1 illustrates a simplified schematic block diagram of a document reproduction system in which the present invention may be applied.

FIG. 1 illustrates a simplified schematic block diagram of a system 108 that includes the multi-drop per spot printer 106. In the system 108, an electronic representation of a document or image from an image input terminal (IIT) 109 derives electronic digital data in some manner from an original image or other source, in a format related to the physical characteristics of the device that typically includes pixels. Typical image input terminals include a scanner 122, a computer image generator 123, such as a personal computer, and an image storage device 124. The electronic digital data signals, transmitted through an image processing unit 119 are processed for suitable reproduction on an image output terminal (IOT) 111 which can include an image storage device 126, a multi-drop per spot printer 106, or a display 125. The multi-drop per spot printer 106 can comprise a variety of different types of printers which include but are not limited to continuous stream printers, drop on demand printers, thermal ink jet printers, piezoelectric printers, and acoustic ink printers. In addition, different kinds of inks can be used to form multiple drops such as liquid inks, phase change wax inks, or aqueous inks. Furthermore, the use of the term "inks" herein is defined as any marking material that can be ejected from the printheads 204–207 which include inks, toners or plastics, or more generally any polymer that is conductive or insulating.

Since printer 106 is a multi-drop per spot printer, the printer can readily print images with multiple gray levels and colors, the specifics of which are described below. Generally, image data received as bitmaps or in a high-level image format, such as a page description language, is rendered by the image processing unit 119 to a format suitable for printing on printer 106. The output of rendered image data from image processing unit 119 is a printfile composed of a multidimensional array of pixel values where each dimension is an array of channel value which is used to represent a color and where each channel value defines a quantity of ink for a color of a pixel on a page of a printed document. Each array of channel values has values that range from zero to N, where N is the maximum number of drops the printer 106 generates per single spot. Thus, the printfile generated by the image processing unit 119 specifies from zero to N drops for each color channel representing a primary color of an image where N corresponds to the gray level specified by the number of drops for that color. For example, a printfile with the primary colors cyan, magenta, and yellow would have a pixel value defined by three color channel values that can range from zero to N.

FIG. 2 illustrates one embodiment of a partial-width array of four printheads 204–207 that are coupled to a controller 214. The controller 214 which slides on rails 216 includes a first drive means for moving the printheads 204–207 in a fast scan direction 212 relative to a recording medium 218 (e.g., paper). While moving in the fast scan direction, the printheads 204–207 eject droplets of ink towards the recording medium 218. After completing a pass in the fast scan direction 212 in which the recording medium 218 is held stationary, the controller 214 directs a second drive means 215 to advance the recording medium 218 in a slow scan direction 213. After completing a pass in the fast scan direction 212, the recording medium 218 advances the length of the printheads 204–207 along the slow scan direction 213. It will be appreciated by those skilled in the art that in an alternate embodiment (not shown), the recording medium 218 is advanced in the fast scan direction relative to the printheads 204–207 which are moved in the slow scan direction.

FIG. 3 illustrates an alternate embodiment in which four printheads 204–207 shown in FIG. 2 are arranged as full-width array printheads. Unlike the partial-width array printheads shown in FIG. 2, the full-width array printheads 204–207 shown in FIG. 3 remain stationary while the recording medium 218 only moves relative to the printheads in fast scan direction 212. Although the embodiments shown in FIGS. 2 and 3 have four printheads 204–207, it will be understood by those skilled in the art that any set of printheads having at least two printheads can be used to perform the present invention and such use would not depart from the spirit and scope of the present invention. For example, the embodiments shown in FIGS. 2 and 3 could include only two of the four printheads 204–207 and continue to carry out the present invention.

FIGS. 4 and 5 illustrate a single acoustic ink printhead 207 shown in FIG. 2 in more detail. FIG. 4 illustrates a bottom-up schematic depiction of eight arrays or rows 436 of apertures or orifices 430 of the printhead 207 taken along view lines 4—4 in FIG. 2. FIG. 5 illustrates a perspective view of a droplet ejector 532 of the printhead 207 taken along dotted box 434 and depicted from view line 5—5 in FIG. 4. Since each droplet ejector 532 is capable of ejecting a droplet with a smaller radius than the droplet ejector, itself, and since full coverage of areas on the recording medium is desired, the individual apertures 430 are arranged in offset rows 436 as shown in FIG. 4. Specifically, eight rows of droplet ejectors 436 are offset at an angle θ to define slightly angled columns 438 of apertures 430. In one embodiment the printhead 207 has one hundred and twenty-eight rows of eight apertures 430. The angled offset of the columns 438 ensures that the center of adjacent pairs of apertures 430 extending along the length of the printhead are evenly spaced a distance "s" therebetween.

Referring now to FIG. 5, each droplet ejector 532 of the printhead 207 is formed on a glass substrate 540. The glass substrate 540 is spaced apart from a liquid level control plate 544 to permit a fluid, such as ink, to flow therebetween. A Fresnel lens 550 is formed on the glass substrate 540 opposite from an aperture 430 in the control plate 544. A piezoelectric transducer 552 is positioned on the opposite side of the glass substrate 540 from the liquid level control plate 544. The piezoelectric device includes a column electrode 554, a row electrode 556 and a piezoelectric layer 558. The piezoelectric layer 558, which is in one embodiment a thin film of ZnO, is sandwiched between a top interface layer 560 and a bottom interface layer 562 of SiN.

Figure 6:
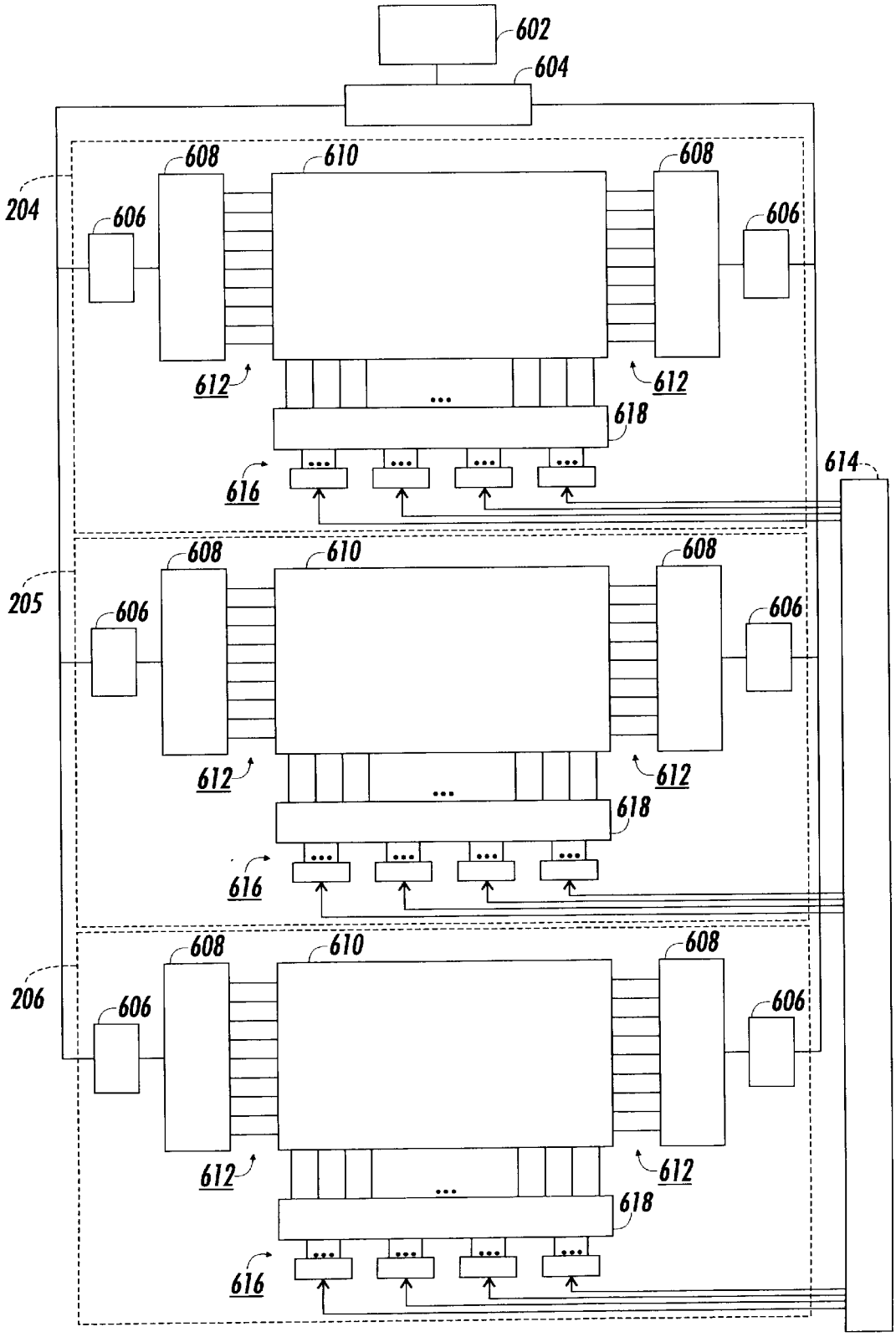
FIG. 6 illustrates a block diagram of the electronic components for driving each piezoelectric transducer layered under each of the apertures shown in FIG. 4.

FIG. 6 illustrates a block diagram of the electronic components of the multi-drop per spot printer 106 having three printheads 204, 205, and 206. The electronic components include common power supply 602 for driving a piezoelectric transducer 552 that is layered under each of the apertures 430 of a printhead 207. In FIG. 6, the common power supply 602 has a radio frequency (RF) source that drives the droplet ejectors of each printhead's transducer array 610. The common RF source 602 is split by power splitter 604 to drive each printhead's pair of RF attenuators 606. Each attenuator 606 is coupled to a row switch 608. Each row switch 608 is adapted to apply the attenuated RF signal to one of the eight column electrodes 554 (shown in FIG. 5) in the transducer array 610 through wire contacts 612. In an alternate embodiment, the power supply 602 is an AC power source, the power splitter 604 is an AC to DC converter, and the attenuators 606 are DC to RF converters.

A memory, which is indicated generally by reference number 614 stores a printfile of an image having a multidimensional array of pixel values. In FIG. 6, the printfile has three dimensions, one dimension for each of the printheads 204, 205, and 206. Each dimension of the multidimensional array of pixel values is used to represent a color channel of a pixel. The three channel values representing each color of the image are input serially to one of the three driver latch shift registers 616. Once channel values for a line of pixel data is received, the values are shifted into data latch 618. Transistor switches (not shown) coupled to data latch 618 are used to address (i.e., turn on) individual piezoelectric transducers 552.

Figure 7:
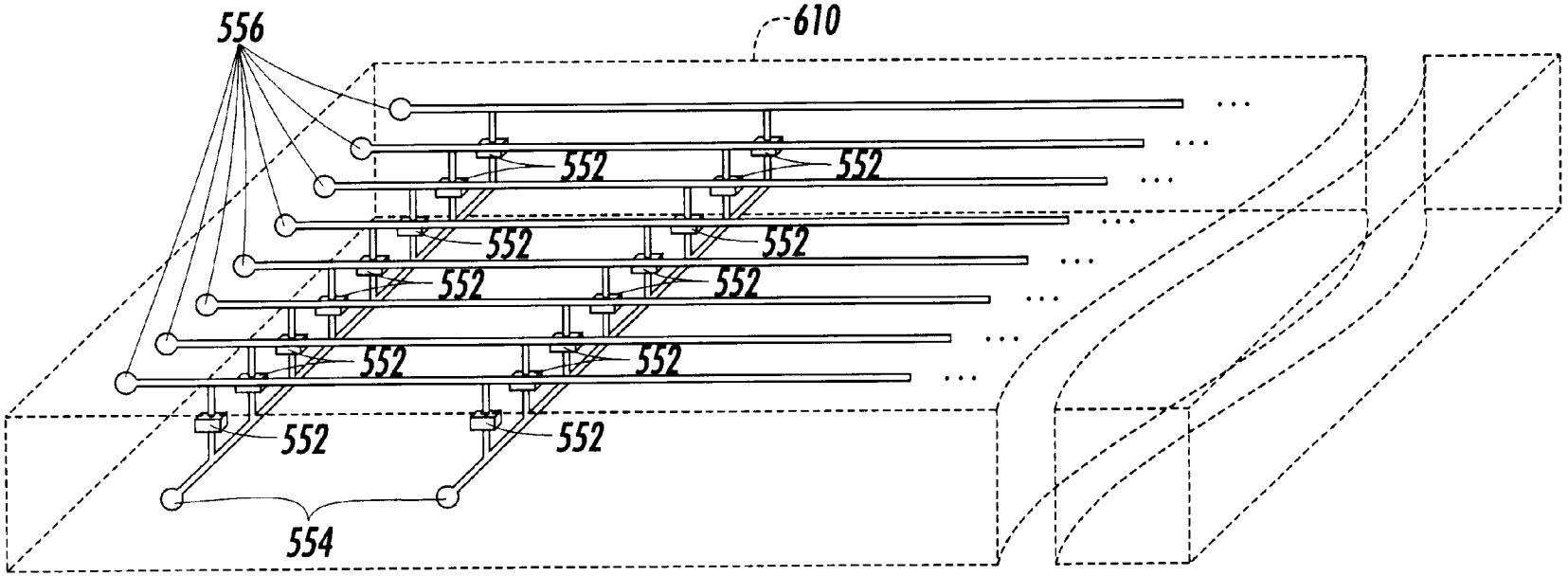
FIG. 7 illustrates a perspective view of a portion of one of the transducer arrays shown in FIG. 6.

FIG. 7 illustrates a perspective view of a portion of one of the transducer arrays 610 shown in FIG. 6. Each piezoelectric transducer 552 in the array 610 is coupled to one of the column electrodes 556 and one of the row electrodes 554. A transducer 552 in the array 610 is activated when row switch 608 delivers the RF source 602 to the corresponding row electrode 556 and the transistor switch coupled (not shown) to data latch 618 activates the corresponding column electrode 554.

Referring again to FIG. 5, during normal operation, ink flows between the glass substrate 540 and the liquid level control plate 544 of each printhead. When an RF signal from the RF source 602 (shown in FIG. 6), is applied between the column electrode 554 and the row electrode 556, the piezoelectric layer 558 generates acoustic energy in the glass substrate 540 (i.e. wavefronts 564) that is directed towards the liquid level control plate 544. The Fresnel lens 550 focuses the acoustic energy (i.e., wavefronts 564) before contacting the ink flowing between the glass substrate 540 and the liquid level control plate 544. The focused acoustic energy (i.e. wavefronts 566) initially forms an ink mound 568 at a free surface of ink in the aperture 430. The ink mound 568 eventually becomes an ink drop 570 that is ejected towards a recording medium (not shown in FIG. 5).

B. Multi-Drop Printing

To facilitate the description of multi-drop per spot printing, single drop per spot printing is illustrated in FIG. 8. Specifically, FIG. 8 illustrates the locations of ink drops deposited by a single-drop per-spot printhead in a 1×1 pattern as known in the art. In such a printhead, for instance printing at 300 spots per inch, the pixels are placed on a square grid having a period of "s" where "s" is generally the spacing between the orifices of the printhead. Ink spots 872 deposited in the pixel areas have pixel centers 874 spaced a distance "s" apart. A single drop per-spot printhead is designed to produce spot diameters of at least 1.414 (the square root of 2) times the grid spacing "s", which is here illustrated as the distance "d". This distance provides complete filling of the pixel space by enabling diagonally adjacent pixels to touch. Consequently, in 1×1 printing (e.g., 300×300), the spots need to be at least 1.41 "s" in diameter to cover the paper. In practice, however, the ink spots or pixels are typically made slightly larger to ensure full coverage of areas on the paper.

Multi-drop per pixel (or spot) printing with liquid ink, in contrast, deposits a number of small ink drops within a pixel space where each drop has a different drop center but which are clustered near the center of the pixel space. These drops are deposited in rapid succession within the pixel space such that ink of each drop merges together and spreads into a larger single spot. Most inks will spread more in the direction perpendicular to the printhead motion since the drops are already spread out in the direction of motion (or process direction). Hence, the resulting spot on the receiving media may be slightly elliptical in shape with the long axis along the direction of motion. Only inks that effectively do not spread at all (very slow dry inks) or inks which finish spreading faster than the drops can be deposited (extremely fast dry ink) would be excluded. Thus, the multiple drops will tend toward the size and shape of a single drop having the same amount of ink, only slightly elongated in the printhead motion direction.

FIG. 9 illustrates a manner of forming a pixel on a recording medium with the multi-drop per spot printhead. The circles in FIG. 9 illustrate the progression of the relative size of a spot as it grows on a recording medium as an increasingly greater number of drops of ink are applied to the same spot. Specifically, each number at the center of the different circles indicates how many ink drops have been added to form the size of the drop. The dotted grid 976 is divided into squares of equal size to illustrate the relative size increase as a series of ten drops are added to form a series of spots of different sizes. That is, the circle 977 represents an ink spot when it is filled with one drop of ink, while the circle 978 represents the ink spot after it has been filled with ten drops of ink. Note that the spot 978 with ten drops has reached the comparable size of the ink spot 872 shown in FIG. 8 produced by a single-drop per spot printhead. It will be understood by those skilled in the art that the relative spot sizes and shapes shown in FIG. 9 is illustrative and will vary depending on many characteristic of the printing materials and environment including the particular receiving media, ink, thermal environment, and printhead used to generate each spot of ink.

The ink spot (or pixel) 978 shown in FIG. 9 is formed on a recording medium by rapidly ejecting ten drops of ink from one or more droplet ejectors 532 of the printhead 207 (shown in FIG. 5) as it moves across the recording medium 218. To accomplish this, the droplet ejectors 532 of the printhead 207 deposit ink drops in less time than it takes to move the printhead a single pixel spacing. The ten individual ink drops, which arrive at the recording medium close in both space and time to each other, are pulled by surface tension to coalesce into a single pool of liquid to form a spot or pixel of ink. In contrast with single drop per spot printing of same spatial resolution, multi-drop per spot printing reduces the drop volume and increases the firing frequency or drop ejection rates such that the spacing between adjacent drops is reduced to a fraction of the width of a pixel. The adjacent drops have a large amount of overlap, typically one-third or more, which causes the ink to spread in the directions perpendicular to the axis of overlap. For example, FIG. 10 illustrates how droplets having one to three drops per spot (i.e., N=3) are formed along fast scan direction 212 on a low addressability grid in pixel locations 1002, 1004, and 1006, respectively. Each of the pixels resulting drop sizes after spreading occurs are illustrated as pixels 1003, 1005, and 1007, respectively.

C. Synchronized Droplet Ejector Firing

FIG. 11 is a graph that illustrates how many drops of ink are used on average to form a spot of ink during a spot cycle of a multi-drop per spot printer. The spot cycle illustrated in the graph is defined as having ten intervals over which a maximum of ten drops of ink are fired (i.e., N=10) in a monotonically increasing order. That is, each spot that is created during the spot cycle with less than N=10 drops of ink (e.g., N=5), starts with the first drop and continues sequentially until the last drop is fired (e.g., 1, 2, 3, 4, 5). Accordingly, drops in the sequence are not fired out of order (e.g., 1, 4, 3, 2, 5) or skipped (e.g., 1, 2, 3, 5, 7). The graph illustrates the principle that the number of times each enumerated drop of ink in a spot cycle is fired decreases monotonically over a spot cycle. The horizontal axis of the graph identifies each actuation interval of a spot cycle over which a sequence of drops of ink are used to form a spot of ink. The vertical axis of the graph identifies the percentage of times that each drop of ink in the sequence of drops of ink is used to form a spot of ink. Depending on the number of drops used to form a spot of ink, different spot sizes are formed on a recording medium as shown in FIG. 9. For the population of spots illustrated in the graph in FIG. 11, approximately 70% of the first drops of a spot cycle are used to form a spot of ink while approximately only 10% of the ninth drops of a spot cycle are used to form a spot of ink.

Figure 12:
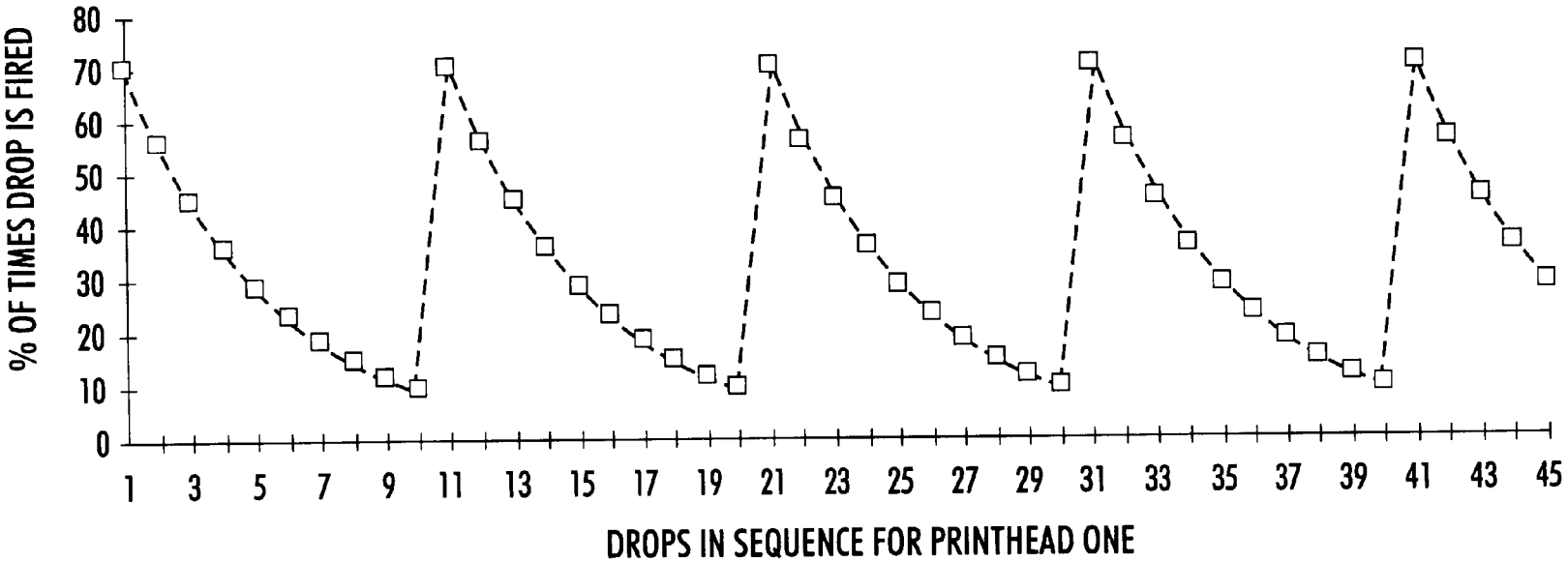
FIG. 12 is a graph which shows the spot cycle shown in FIG. 11 repeating for several periods.

It has been observed that the general shape of the curve of the spot cycle shown in FIG. 11 is characteristic of printhead operation. It has also been observed that the exact shape of the curve of the spot cycle varies depending on the particular printhead of a multiple printhead system and the particular operating environment in which the printhead operates. FIGS. 12–15 are graphs of repeating spot cycles that are characteristic of a multiple printhead system operating in a particular environment. More specifically, FIG. 12 is a graph that illustrates the spot cycle in FIG. 11 repeating over several periods. Similar to FIG. 12, FIGS. 13–15 are graphs that show the spot cycles for three additional printheads 204–207 repeating over several periods. In one embodiment, FIGS. 12–15 correspond to the spot cycles for the printheads 204–207 shown in FIG. 2, which eject the colors black, cyan, magenta, and yellow, respectively. The four different graphs in FIGS. 12–15 illustrate that the percentage of times each enumerated drop in a spot cycle is fired varies depending on which color spot is formed on the recording medium. For example, 70% of the first droplets of the black ink spot cycle are fired on average as illustrated in FIG. 12, while only 30% of the first droplets of the yellow ink spot cycle are fired on average as illustrated in FIG. 15.

Figure 13:
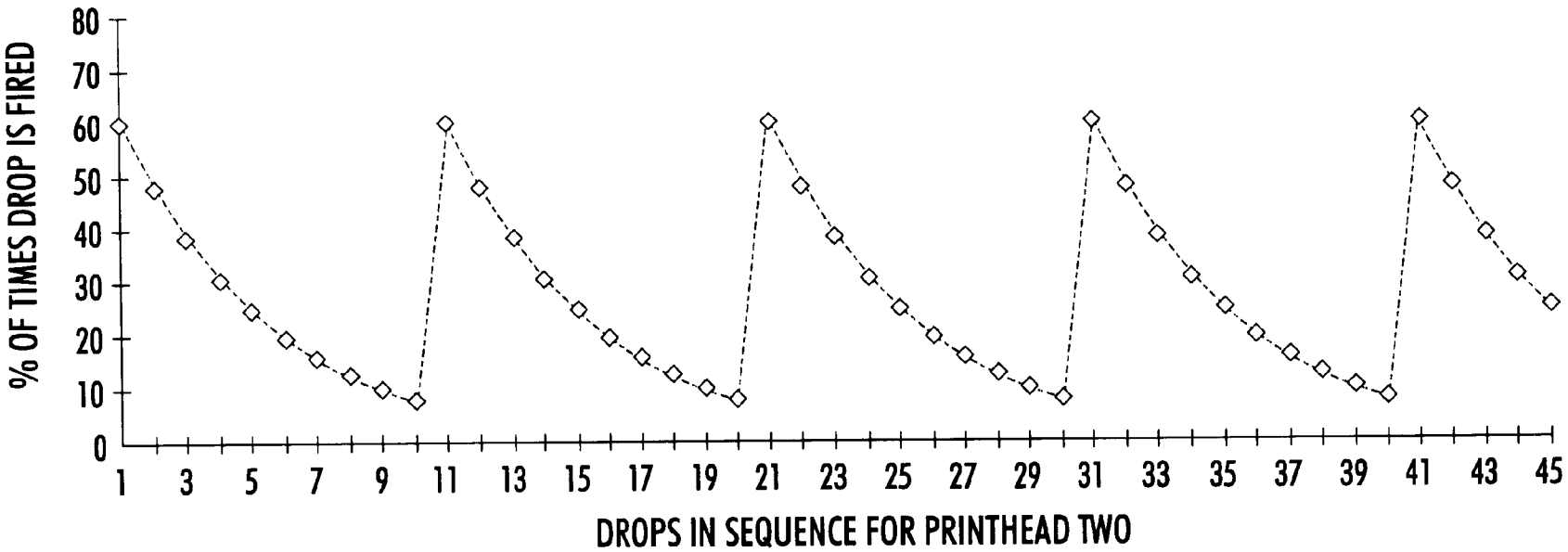
FIGS. 13–15 are graphs that show repeating spot cycles of three other printheads in the printing system.
Figure 14:
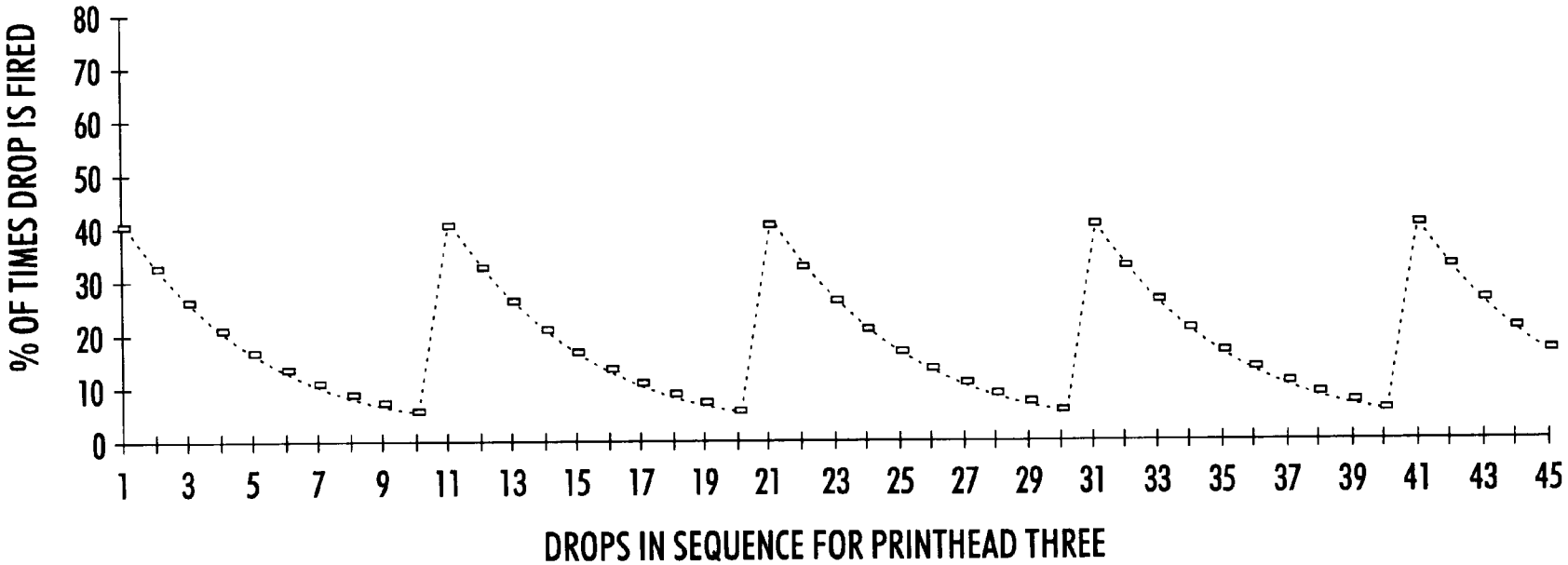
Figure 15:
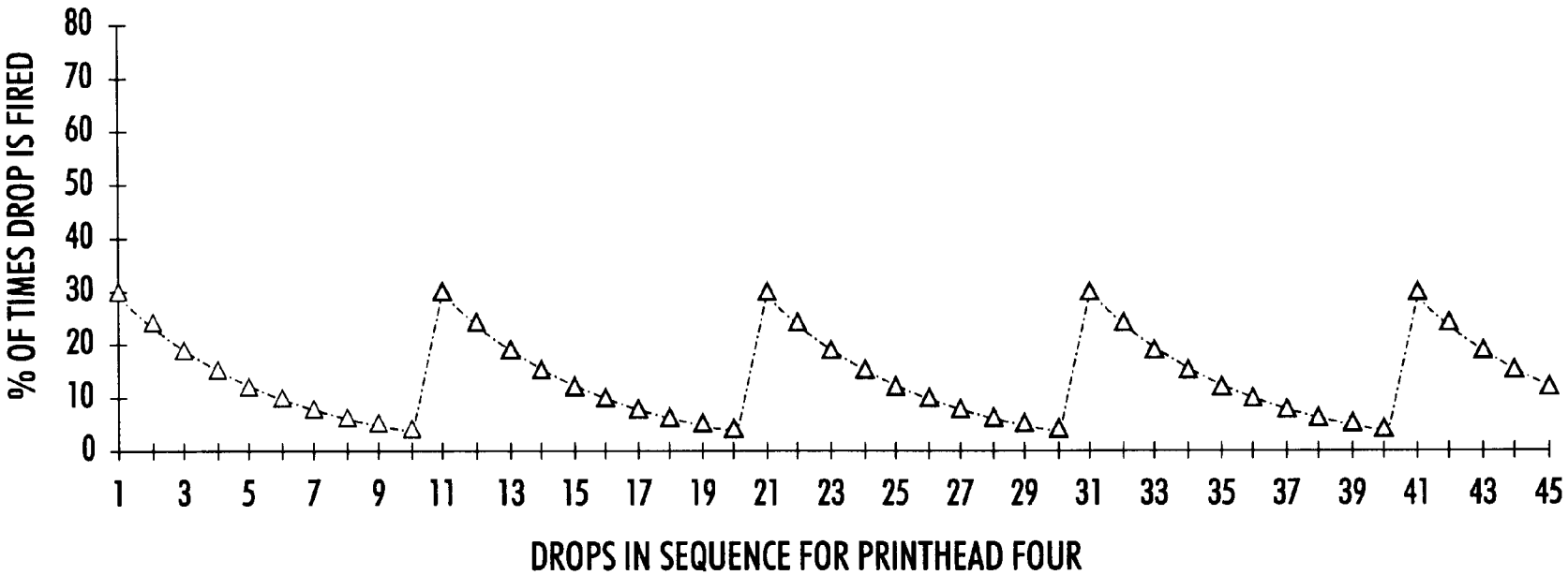
Figure 16:
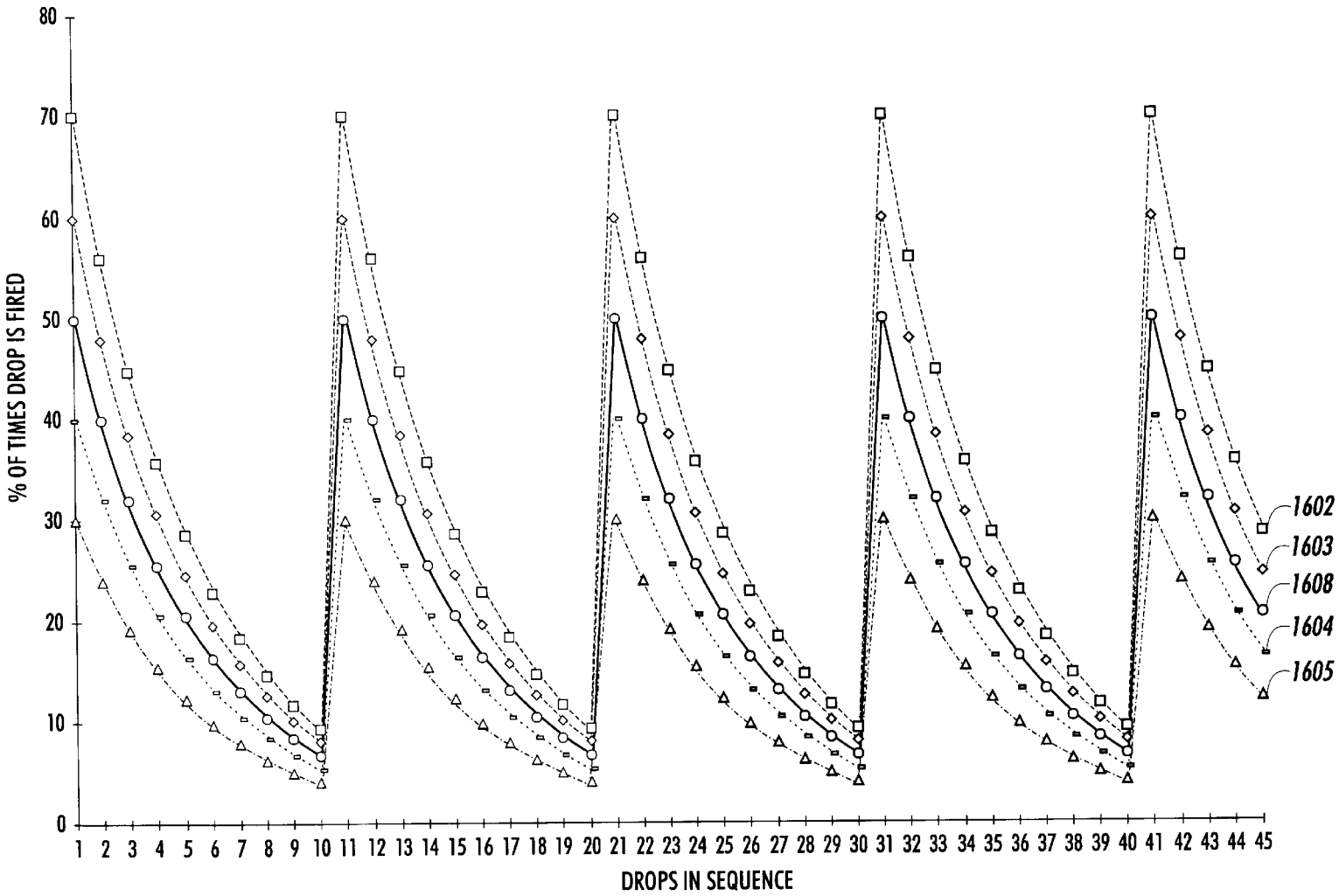
FIG. 16 is a graph in which the spot cycles of the four printheads shown in FIGS. 13–15 are synchronized over a drop sequence.

FIG. 16 is a graph in which the drop sequences of the spot cycles of the four printheads shown in FIGS. 13–15 are synchronized. More specifically, curves 1602–1605 correspond to graphs of the drop sequences set forth in FIGS. 12–15, respectively. That is, the curves 1602–1605 have been arranged so that each drop fired for each of the printheads during a spot cycle are fired on the same enumerated drop in the spot cycle (e.g., the first drop in each spot cycle is fired at the same time, the second drop in each spot cycle is fired at the same time, etc.). In addition, curve 1608, on the graph shown in FIG. 16, illustrates the average number of drops fired for the four curves 1602–1605. When drop ejection is synchronized as shown in FIG. 16, the curve 1608 illustrates that the average of each of the curves 1602–1605 produces a curve that is also monotonically decreasing over a spot cycle.

It has been found that the average distribution of droplet firing for multiple printheads (e.g., curve 1608) can be used to predict the peak power requirements of the common power source 602 (see FIG. 6) that drives the four printheads 204–207 each interval of a spot cycle during which a droplet can be fired. The curve 1608 in the graph in FIG. 16 illustrates that the common power supply 602 must support a maximum peak power usage in which on average 50% of the ejectors of each printhead are fired simultaneously when ejecting the first droplet of a spot cycle. Note that this is only true for the first droplet of a spot cycle. During other droplets of the spot cycle, such as droplets nine and ten, common power supply 602 must only supply power sufficient to fire less than 10% the droplet ejectors of each of the printheads. Although the maximum peak power usage shown is less than what would be required for 100% coverage, power is distributed inefficiently when droplet ejectors are synchronized as shown by the monotonically decreasing requirements for power over a spot cycle.

D. Desynchronized Droplet Ejector Firing

Figure 17:
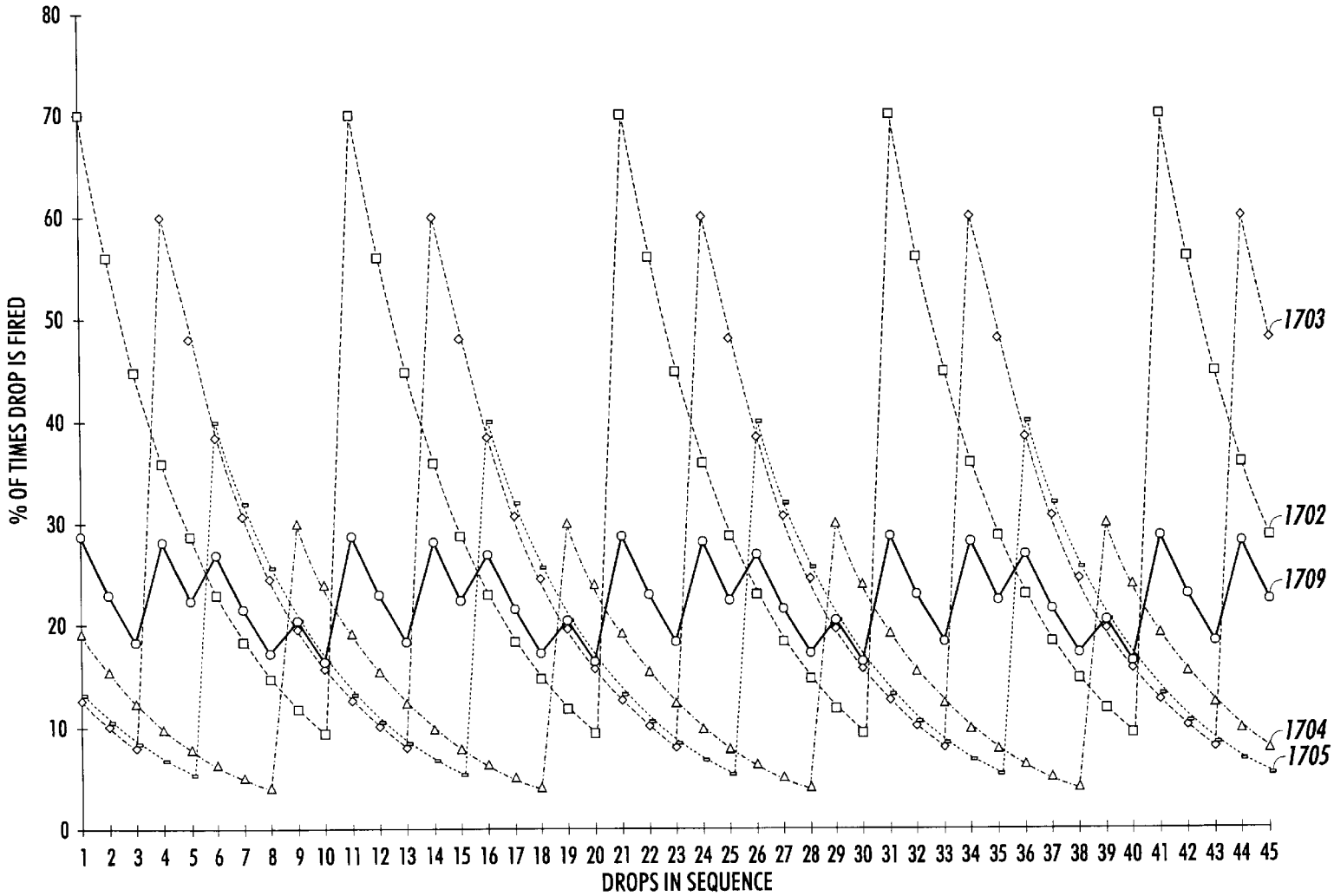
FIG. 17 illustrates a drop sequence in which the four spot cycles illustrated in FIGS. 12–15 are out of phase to desynchronize droplet ejector firing of multiple printheads.

In accordance with the invention, droplet ejector firing between printheads is desynchronized over a spot cycle. This desynchronization of multiple printhead spot cycles advantageously reduces the peak power requirements of the common power source 602 compared with synchronized spot cycles. Droplet ejector firing is desynchronized by staggering the start of each printhead's spot cycle. Staggering the start of each printhead's spot cycle effectively arranges each printhead's spot cycle so that it is out of phase with the spot cycles of other printheads (i.e., desynchronized). FIG. 17 illustrates a drop sequence in which the four spot cycles illustrated in FIGS. 12–15 are out of phase with each other. That is, the four spot cycles illustrated in FIGS. 12–15 are begun at different actuation intervals as a sequence of drops are fired. In one embodiment, the spot cycles are shifted by four, six, and nine droplets. More specifically, curve 1702, which corresponds to the spot cycle shown in FIG. 12, begins its spot cycle at the $1^{st}$, $11^{th}$, $21^{st}$, $31^{st}$, and $41^{st}$ drops in the sequence of 45 drops in FIG. 17. In contrast, the curves 1703, 1704, and 1705, which correspond to the spot cycle shown in FIGS. 13, 14, and 15, respectively, begin their spot cycles at different actuation intervals. Specifically in the sequence of drops shown in FIG. 17, the spot cycle illustrated by the curve 1703 begins at the $4^{th}$, $14^{th}$, $24^{th}$, $34^{th}$ and $44^{th}$ drops, the spot cycle illustrated by the curve 1704 begins at the $6^{th}$, $16^{th}$, $26^{th}$ and $36^{th}$ drops, and the spot cycle illustrated by the curve 1705 begins a the $9^{th}$, $19^{th}$, $29^{th}$ and $39^{th}$ drops.

As illustrated in FIG. 17, each of the spot cycles of the four printheads are shifted by some number of printhead actuation intervals (i.e., the time it takes to fire one or more drops of ink) in order to desynchronize droplet ejector firing. By desynchronizing the droplet ejectors of the four printheads, the average of the four curves 1702–1705 tends to flatten out as illustrated by average curve 1709. As compared to the average curve 1608 of synchronized droplet ejector firing over a spot cycle, the average curve 1709 of desynchronized droplet ejector firing over a spot cycle has a lower maximum percentage of droplets fired over time. Specifically, the graph shown in FIG. 17 shows that the maximum percentage of droplets fired during any one of the spot cycles is less than 30%, a decrease of over 20%. It will be understood by those skilled in the art that other distributions of data may exist in which the exact manner in which spot cycles of printheads are desynchronized will vary. In principle, a preferred embodiment of the invention is one in which the peak number of drops fired of multiple printheads driven by a common power supply is minimized over time.

Advantageously, by minimizing the peak number of drops fired by multiple printheads over time, the common power supply 602 (shown in FIG. 6) of the printing system has a lower peak power capacity requirement. As set forth above, the curve 1709 can be used to approximate the peak power requirements of a multiple printhead system when the power consumption of each printhead increases linearly as the percentage of printhead ejectors fired is increased. In reality, printhead power consumption tends to increase monotonically as the percentage of printhead ejectors fired is increased. Desynchronizing droplet ejector firing of multiple printheads with power consumption that increases monotonically effectively lowers the RMS (root mean squared) of the peak power consumption of the printheads.

By desynchronizing droplet ejector firing of multiple printheads peak power requirements of the printing system are advantageously reduced compared to the peak power requirements of a system with synchronized droplet ejector firing. As illustrated in FIG. 16, synchronized droplet ejector firing requires a power supply that supports power capacity sufficient to fire at least fifty percent of all of the droplet ejectors. In contrast assuming power consumption increases linearly, desynchronized droplet ejector firing for the same system requires only that the peak power capacity of the power supply be sufficient to fire at most thirty percent of all of the droplet ejectors.

Figure 18:
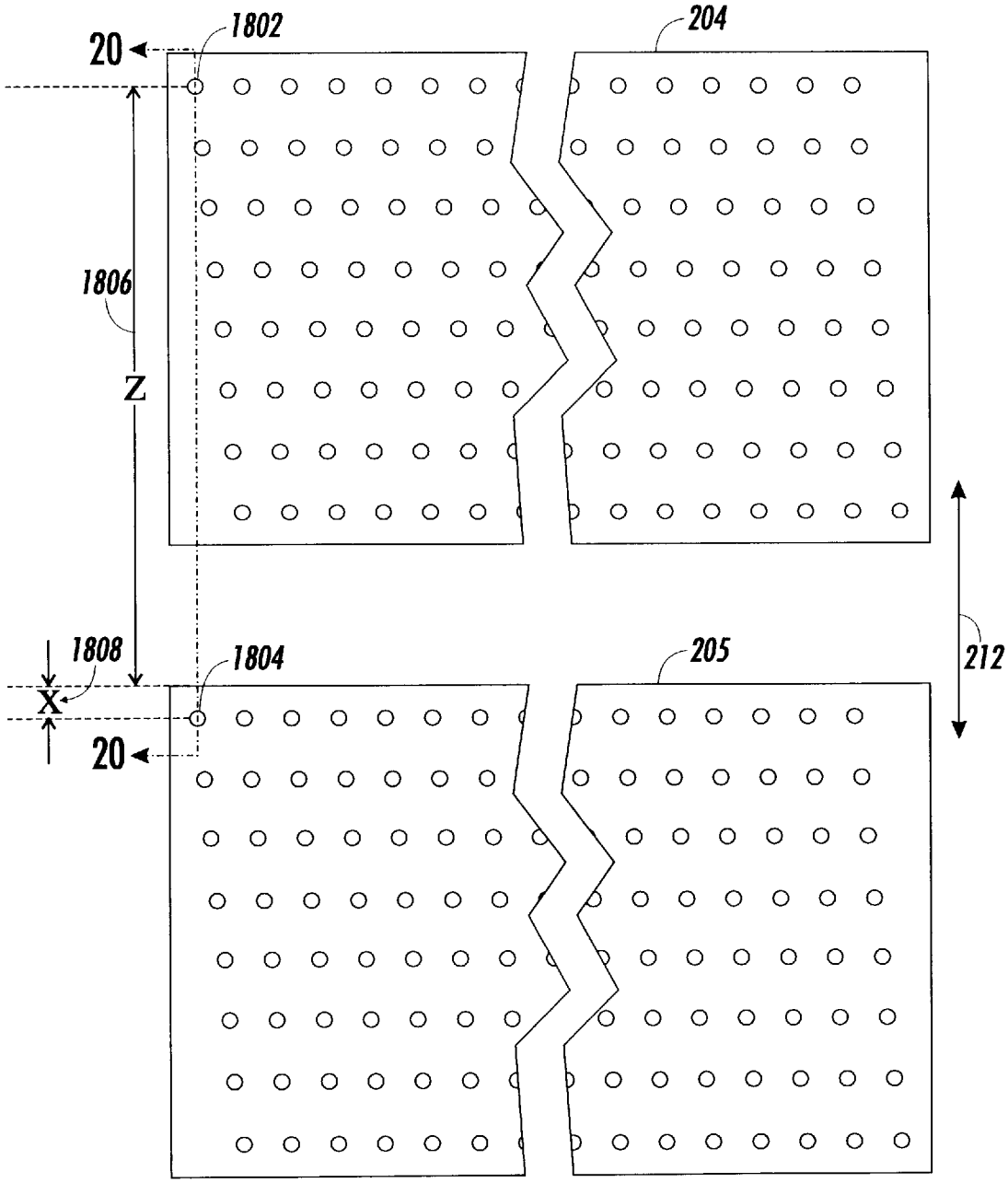
FIG. 18 illustrates one embodiment in which two printheads shown in FIG. 2 are desynchronized.

The spot cycles of the printheads 204 and 205 are desynchronized by offsetting each printhead a non-multiple number of N drops. By way of illustration, FIG. 18 is a bottom-up schematic depiction of two of the four printheads 204–207 shown in FIG. 2. The droplet ejector 1802 and 1804 of the printheads 204 and 205 are aligned along the process direction 212. The distance between two droplet ejectors 1802 and 1804 is represented by distance "z+x". The distance "z" is indicated by reference number 1806, and distance "x" is indicated by reference number 1808. In general, the distance "z+x" is given by the following equation:

$$z + x = \frac{(nD) + m}{sD},$$

where, n=an integral number of "spot" separations greater than zero, s=spots per inch, D=drops per spot, and m=some integral number of "drop" separations where D>m>0.

Figure 19:
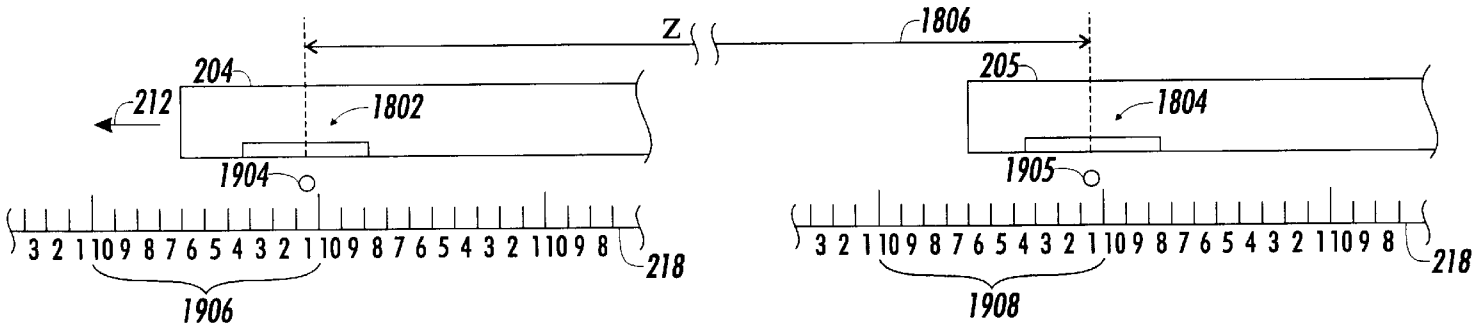
FIG. 19 illustrates an example in which the two printheads have synchronized drop sequences.
Figure 20:
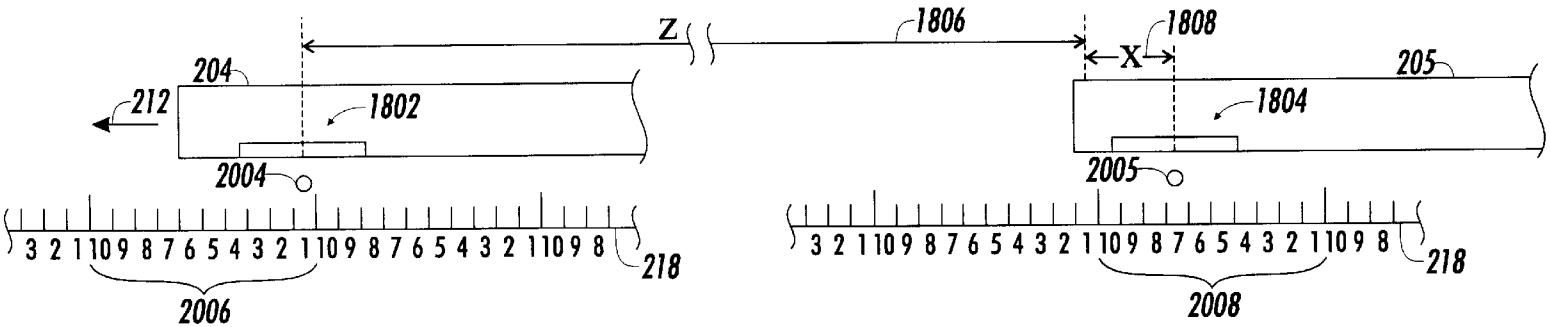
FIG. 20 illustrates two printheads 204 and 205 taken along view line 20—20 shown in FIG. 17 with desynchronized spot cycles.

When two printheads have synchronized drop sequences, the distance "x" which is given by reference number 1808 equals zero and the distance "z" given by the reference number 1806 equals n/s. However, when two printheads are desynchronized then the distance "x" given by reference number 1808 is non-zero (i.e., m/sD). When more than two printheads are desynchronized, the same method is applied between succeeding printheads (e.g., between printhead two and printhead three). For example, assuming a printing system with the four printheads 204–207 shown in FIGS. 2 or 3 have desynchronized spot cycles as shown in FIG. 17 in graphs 1702–1705, respectively, each of the printheads 205–207 are offset a number of "m" droplet separations as follows: the number of "m" drop separations between the printhead 204, which associated with curve 1702, and the printhead 205, which is associated with curve 1703, is equal to three (i.e., "m"=3); the number of "m" drop separations between the printhead 205, which associated with curve 1703, and the printhead 206, which is associated with curve 1704, is equal to two (i.e., "m"=2); and the number of "m" drop separations between the printhead 206, which associated with curve 1704, and the printhead 207, which is associated with curve 1705, is equal to three (i.e., "m"=3) .FIG. 19 illustrates an example in which the two printheads 204 and 205 have synchronized drop sequences. In contrast, FIG. 20 illustrates another example in which the two printheads 204 and 205 taken along view line 20—20 shown in FIG. 17 have desynchronized drop sequences. Both FIGS. 19 and 20 only show portions of each of the printheads 204 and 205. Also, as set forth in FIG. 6 droplet ejectors of the printheads 204 and 205 are driven by a common power (i.e., RF) source 602.

More specifically, in FIG. 19 two printheads 204 and 205 have synchronized spot cycles because corresponding droplet ejectors 1802 and 1804 deliver the same drop in their spot cycles at the same time. As shown in the FIG., the droplet ejectors 1802 and 1804 deliver ink droplets, in the process direction 212, to locations on the recording medium on the same enumerated drop location of a spot. In this example, both ejectors 1802 and 1804 deliver the first drop of ink for ink spots 1906 and 1908, respectively. In operation, a common power source simultaneously energizes droplet ejectors 1802 and 1804 in printheads 204 and 205 to fire droplets 1904 and 1905, respectively.

In contrast, FIG. 20 illustrates two printheads 204 and 205 taken along view line 20—20 shown in FIG. 17 with desynchronized spot cycles. In this example, the corresponding droplet ejectors 1802 and 1804 of the printheads 204 and 205, respectively, deliver different drops of ink of a spot as the ejectors are energized by a common power source 602 (shown in FIG. 6). Specifically, FIG. 20 shows droplet ejector 1802 delivering droplet 2004 which is the first droplet of ink spot 2006, and droplet ejector 1804 delivering droplet 2005 which is the seventh drop of ink spot 2008. In other words, the printhead 204 is delivering the first drop of its spot cycle while printhead 205 is delivering the seventh drop of its spot cycle.

Referring to FIG. 20 together with FIG. 6, the spot cycles of printheads 204 and 205 are desynchronized by beginning the spot cycle of printhead 204 four droplets before printhead 205 begins its spot cycle. Staggering the start of the printhead spot cycles arranges the spot cycles of the two printhead out of phase with each other by beginning the spot cycle of the printhead 204 a non-multiple of N=10 drops before the printhead 205 begins its spot cycle. In addition to physically spacing the two printheads a non-multiple of N=10 droplets apart, the pixel values being input from memory 614 must account for the spot cycles of the printheads being out of phase. That is, the pixel values of a document which are input serially to data latches 616 for each of the printheads 204 and 205 must be desynchronized as well. What is required for proper operation is for the memory 614 to deliver to each set of data latches 616 pixel values that correspond to the locations at which droplet ejectors are positioned over the recording medium 218.

Advantageously, desynchronizing the data that is input serially to data latches 616 reduces the bandwidth required to access the printfile stored in memory 614. When multiple printheads are synchronized, data for each color channel of a pixel must be accessed simultaneously from memory. However, when the spot cycles of the printheads are desynchronized, data for each color channel can be accessed from memory 614 asynchronously. With asynchronous memory accesses, the bandwidth required to access pixel data in memory 614 is reduced because requests for color channel data need not occur simultaneously but instead can occur at different intervals during a spot cycle. Thus, desynchronizing printhead spot cycles, advantageously reduces both the average peak power consumption of the printheads, as well as, the bandwidth required to access the pixel data of a printfile stored in a memory.

Figure 21:
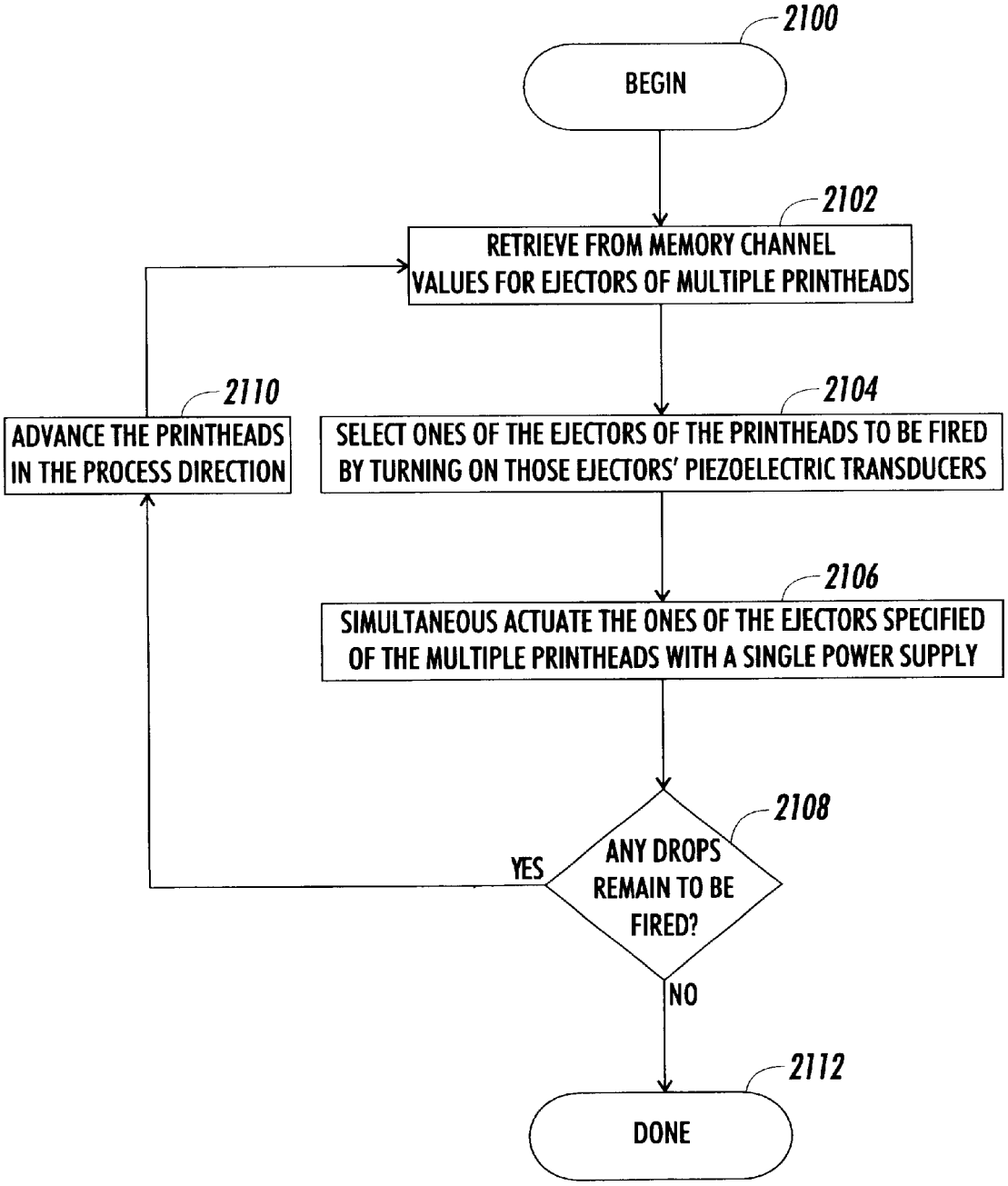
FIG. 21 is a flow diagram setting forth the steps for desynchronizing droplet ejector firing in accordance with the present invention.

FIG. 21 is a flow diagram that sets forth the steps for desynchronizing droplet ejector firing in accordance with the present invention. Generally, the steps shown in FIG. 21 are performed for each interval of a spot cycle. At step 2100, the printer 106 begins printing an image recorded in memory 614 on a recording medium. Channel values of pixels are retrieved from memory for the printer's multiple printheads, at step 2102. Using the channel values, ones of the ejectors of the multiple printheads are selected to be fired by turning on those ejectors piezoelectric transducers, at step 2104. Finally, to complete an interval of a spot cycle, those ejectors which are selected to be fired at step 2104 are simultaneously actuated using a single power supply at step 2106. At step 2108, if any drops remain to be fired to finish reproducing on the recording medium the image in memory, then the printhead is advanced in the process direction a single droplet spacing at step 2110; otherwise, printing of the image recorded in memory completes at step 2112. It will be appreciated by those skilled in the art that many of the steps shown in FIG. 21 need not be performed sequentially but may instead be performed in parallel.

E. Summary

A printing system with phase shift printing has been described. It will be appreciated, however, that the present invention is not limited to a printing system that deposits ink on a recording medium but may in addition include a wide variety of non-printing applications where a material is deposited on a supporting structure.

The invention has been described with reference to a particular embodiment. Modifications and alterations will occur to others upon reading and understanding this specification taken together with the drawings. The embodiments are but examples, and various alternatives, modifications, variations or improvements may be made by those skilled in the art from this teaching which are intended to be encompassed by the following claims.

What is claimed is:

1. A multiple drop per spot printing system, comprising:

a first printhead and a second printhead having ejectors for ejecting drops of ink onto a recording medium; the ejectors of each printhead having a spot cycle with N actuation intervals, where N is an integer greater than one; each ejector ejecting onto the recording medium at most one drop of ink during each actuation interval of the spot cycle forming a spot of ink having up to N drops of ink;

a memory, coupled to said first printhead and said second printhead, for specifying a set of ejectors from said first printhead for a first actuation interval of the spot cycle and a set of ejectors from said second printhead for a second actuation interval of the spot cycle with the first actuation interval of the spot cycle of said first printhead being out of phase with the second actuation interval of the spot cycle of said second printhead by an integral number of actuation intervals less than N; and a power supply, coupled to said first printhead and second printhead, for simultaneously actuating the first set of ejectors from said first printhead and the second set of ejectors from said second printhead specified by said memory.

2. The multiple drop per spot printing system according to claim 1, wherein the spot cycle of said first printhead begins a non-integral multiple number of N actuation intervals prior to the spot cycle of said second printhead.

3. The multiple drop per spot printing system according to claim 1, wherein said second printhead is offset from said first printhead in a process direction a non-integral multiple number of N drop separations.

4. The multiple drop per spot printing system according to claim 1, further comprising:

a first ejector integrated in said first printhead; and a second ejector integrated in said second printhead;

wherein said first ejector is offset from said second printhead a distance given by $$\frac{(nD)+m}{sD},$$

where, n=an integral number of spot separations greater than zero, s=spots per inch, D=drops per spot, and m=some integral number of drop separations where D>m>0.

5. The multiple drop per spot printing system according to claim 1, further comprising a third printhead having a spot cycle during which N drops of ink are ejected to form a spot of ink on the recording medium.

6. The multiple drop per spot printing system according to claim 5, wherein said third printhead is out of phase with the spot cycle of said first printhead and the spot cycle of said second printhead.

7. The multiple drop per spot printing system according to claim 1, wherein said first printhead and said second printhead are acoustic ink printheads.

8. The multiple drop per spot printing system according to claim 7, wherein said power supply is a RF power supply.

9. The multiple drop per spot printing system according to claim 1, wherein said memory comprises:

a first data latch coupled to said first printhead; and a second data latch coupled to said second printhead.

10. The multiple drop per spot printing system according to claim 1, wherein said first printhead further comprises an array of transducers arranged by rows of transducers and columns of transducers; said rows of transducers being coupled to said power supply and said columns of transducers being coupled to said memory.

11. The multiple drop per spot printing system according to claim 1, wherein said first printhead and said second printhead are partial width array printheads.

12. The multiple drop per spot printing system according to claim 1, wherein said first printhead and said second printhead are full width array printheads.

13. The multiple drop per spot printing system according to claim 1, wherein N equals ten.

14. The multiple drop per spot printing system according to claim 1, wherein said memory records a multidimensional array of pixel values of an image.

15. The multiple drop per spot printing system according to claim 1, wherein said memory stores a printfile with a multidimensional array of pixel values, wherein each dimension represents an N bit channel value.

16. The multiple drop per spot printing system according to claim 15, wherein the channel values of a pixel value in the printfile stored in said memory are asynchronously retrieved from said memory.

17. A method for operating a multiple drop per spot printing system having a first printhead and a second printhead with ejectors, the ejectors of each printhead having a spot cycle with N actuation intervals, where N is an integer greater than one; each ejector ejecting onto the recording medium at most one drop of ink during each actuation interval of the spot cycle forming a spot of ink having up to N drops of ink said method comprising the steps of:

specifying, with a memory of the multiple drop per spot printing system, a set of ejectors from the first printhead for a first actuation interval of the spot cycle and a set of ejectors from the second printhead for a second actuation interval of the spot cycle, with the first actuation interval of the spot cycle of the first printhead being out of phase with the second actuation interval of the spot cycle of the second printhead by an integral number of actuation intervals less than N; and simultaneously actuating, with a power supply of the multiple drop per spot printing system, the ejectors in the first set of ejectors from the first printhead and the second set of ejectors from the second printhead specified by said specifying step.

18. The method according to claim 17, further comprising the step of beginning the spot cycle of the first printhead a non-integral multiple number of N drops prior to beginning the spot cycle of the second printhead.

19. The method according to claim 17, further comprising the step of asynchronously retrieving from a memory channel values of each pixel.

* * * * *